US010951981B1

(12) United States Patent
Chen et al.

(10) Patent No.: US 10,951,981 B1
(45) Date of Patent: Mar. 16, 2021

(54) LINEAR DIFFERENTIAL MICROPHONE ARRAYS BASED ON GEOMETRIC OPTIMIZATION

(71) Applicant: Northwestern Polytechnical University, Shanxi (CN)

(72) Inventors: Jingdong Chen, Shanxi (CN); Jilu Jin, Shanxi (CN); Gongping Huang, Shanxi (CN)

(73) Assignee: Northwestern Polyteclmical University, Shanxi (CN)

( * ) Notice: Subject to any disclaimer, the term of this patent is extended or adjusted under 35 U.S.C. 154(b) by 0 days.

(21) Appl. No.: 16/717,644

(22) Filed: Dec. 17, 2019

(51) Int. Cl.
*H04R 3/00* (2006.01)
*H04R 1/40* (2006.01)

(52) U.S. Cl.
CPC ..... *H04R 1/406* (2013.01); *H04R 3/005* (2013.01); *H04R 2201/401* (2013.01); *H04R 2430/21* (2013.01)

(58) Field of Classification Search
CPC ..... H04R 1/406; H04R 3/005
See application file for complete search history.

(56) References Cited

U.S. PATENT DOCUMENTS 9,100,735 B1 * 8/2015 Taenzer ..... H04R 3/005
2003/0142836 A1 * 7/2003 Warren ..... H04R 25/407 381/92
2004/0022397 A1 * 2/2004 Warren ..... H04R 3/005 381/92
2005/0195988 A1 * 9/2005 Tashev ..... H04R 3/005 381/92
2009/0175466 A1 * 7/2009 Elko ..... H04R 25/407 381/94.2
2013/0272097 A1 * 10/2013 Kim ..... G01S 5/186 367/129
2014/0314251 A1 * 10/2014 Rosca ..... H04R 1/406 381/92
2017/0295436 A1 * 10/2017 Pedersen ..... H04R 25/405
2018/0033447 A1 * 2/2018 Ramprashad ..... G10L 21/0216
2018/0249246 A1 * 8/2018 Kjems ..... G10L 21/0216
2019/0104357 A1 * 4/2019 Atkins ..... H04R 1/406
2019/0253813 A1 * 8/2019 Pedersen ..... H04R 25/405
2020/0058310 A1 * 2/2020 Goodwin ..... H04R 5/04
2020/0154200 A1 * 5/2020 McCowan ..... H04R 3/005

* cited by examiner

*Primary Examiner* — Simon King
(74) *Attorney, Agent, or Firm* — Zhong Law, LLC

(57) ABSTRACT

An $N^{th}$ order linear differential microphone array (LDMA) including at most M microphones, where M is greater than N, is constructed by identifying a number K of combinations of at least (N+1) of the M microphones. A target cost function is specified based on at least one of a directivity factor, a beampattern, or a white noise gain associated with the LDMA. For each frequency band of a plurality of frequency bands: an optimal combination of microphones, from the K combinations, is determined based on an evaluation of the target cost function for the band and beamforming is performed using the determined optimal combination for the band. A union of the optimal combinations of microphones for the plurality of bands may be determined and the LDMA may be constructed, using microphones in the union, based on an evaluation of the target cost function across the plurality of bands.

20 Claims, 6 Drawing Sheets

LINEAR DIFFERENTIAL MICROPHONE ARRAYS BASED ON GEOMETRIC OPTIMIZATION

TECHNICAL FIELD

This disclosure relates to differential microphone arrays and, in particular, to constructing a linear differential microphone array (LDMA) based on optimizing an array geometry of the LDMA with respect to performance targets.

BACKGROUND

A differential microphone array (DMA) uses signal processing techniques to obtain a directional response to a source sound signal based on differentials of pairs of the source signals received by microphones of the array. DMAs may contain an array of microphone sensors that are responsive to the spatial derivatives of the acoustic pressure field generated by the sound source. A flexible DMA may include flexibly (e.g., non-uniformly) distributed microphones that are arranged on a common platform according to the array's geometry (e.g., linear, circular or other array geometries).

The DMA may be communicatively coupled to a processing device (e.g., a digital signal processor (DSP) or a central processing unit (CPU)) that includes circuits programmed to implement a beamformer to calculate the estimate of the sound source. A beamformer is a spatial filter that uses the multiple versions of the sound signal captured by the microphones in the microphone array to identify the sound source according to certain optimization rules. A beampattern (also known as a directivity pattern) reflects the sensitivity of the beamformer to a plane wave impinging on the DMA from a particular angular direction.

BRIEF DESCRIPTION OF THE DRAWINGS

The present disclosure is illustrated by way of example, and not by way of limitation, in the figures of the accompanying drawings.

DETAILED DESCRIPTION

Figure 1:
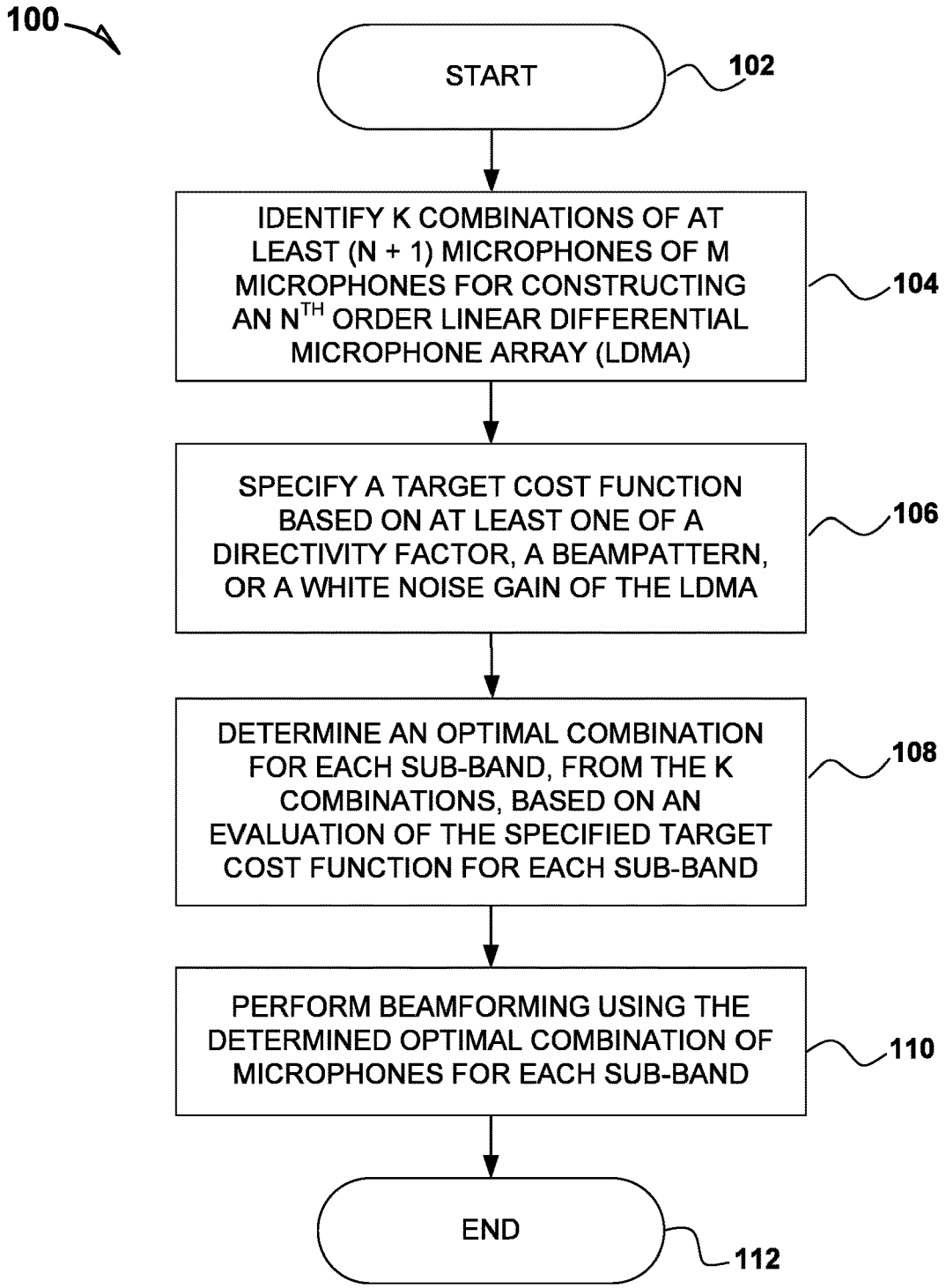
FIG. 1 is a flow diagram illustrating a method for constructing a linear differential microphone array (LDMA) based on geometric optimization for each frequency band of a plurality of frequency bands, according to an implementation of the present disclosure.

DMAs may measure the derivatives (at different orders) of the sound signals captured by each microphone, where the collection of the sound signals forms an acoustic field associated with the microphone array. For example, a first-order DMA beamformer, formed using the difference between a pair of two microphones (either adjacent or non-adjacent), may measure the first-order derivative of the acoustic pressure field, and a second-order DMA beamformer, formed using the difference between a pair of two first-order differences of the first-order DMA, may measure the second-order derivatives of the acoustic pressure field, where the first-order DMA includes at least two microphones, and the second-order DMA includes at least three microphones. Thus, an Nth order DMA beamformer may measure the Nth order derivatives of the acoustic pressure field, where the Nth order DMA includes at least N+1 microphones.

One aspect of a beampattern of a microphone array can be quantified by the directivity factor (DF) which is the capacity of the beampattern to maximize the ratio of its sensitivity in the look direction to its average sensitivity over all directions. The look direction is an impinging angle of the sound signal that has the maximum sensitivity. The DF of a DMA beampattern may increase with the order of the DMA. However, a higher order DMA can be very sensitive to noise generated by the hardware elements of each microphone of the DMA itself. This effect is referred to as white noise gain (WNG). The design of a beamformer for the DMA may focus on finding an optimal beamforming filter under some criterion with an already specified array geometry. Another way to improve beamforming performance (e.g., increasing the array directivity, controlling the sidelobe levels, controlling the grating lobes, and/or improving the robustness) may be through optimizing the array geometry as described herein.

The microphone array geometry (e.g. relative position of array microphones with respect to a reference point) of a DMA can impact the performance of the DMA. The present disclosure includes an approach to the design of a linear differential microphone array (LDMA) of high performance through optimizing the array geometry under the constraints of minimum tolerable inter-element (e.g., inter-microphone) spacing $\delta_{min}$ and maximum tolerable array aperture $L_{max}$. Implementations of the disclosure may include dividing the microphones of the array into subarrays of microphones and then identifying the optimal subarray geometries in a different frequency bands based on specified performance targets. The complete array geometry is then constructed from a union of the optimal subarray geometries based on an evaluation of the specified performance targets across the frequency bands, as explained more fully below with respect to the methods of FIG. 1 and FIG. 2.

For simplicity of explanation, methods are depicted and described as a series of acts. However, acts in accordance with this disclosure can occur in various orders and/or concurrently, and with other acts not presented and described herein. Furthermore, not all presented acts may be required to implement the methods in accordance with the disclosed subject matter. In addition, the methods could alternatively be represented as a series of interrelated states via a state diagram or events. Additionally, it should be appreciated that the methods disclosed in this disclosure are capable of being stored on an article of manufacture to facilitate transporting and transferring such methods to computing devices. The term article of manufacture, as used herein, is intended to encompass a computer program accessible from any computer-readable device or storage media. In an implementation, the methods may be performed by the LDMA 300 of FIG. 3 with an array geometry 400 as shown in FIG. 4.

FIG. 1 is a flow diagram illustrating a method 100 for constructing a linear differential microphone array (LDMA) based on geometric optimization for each frequency band of a plurality of frequency bands, according to an implementation of the present disclosure.

Figure 3:
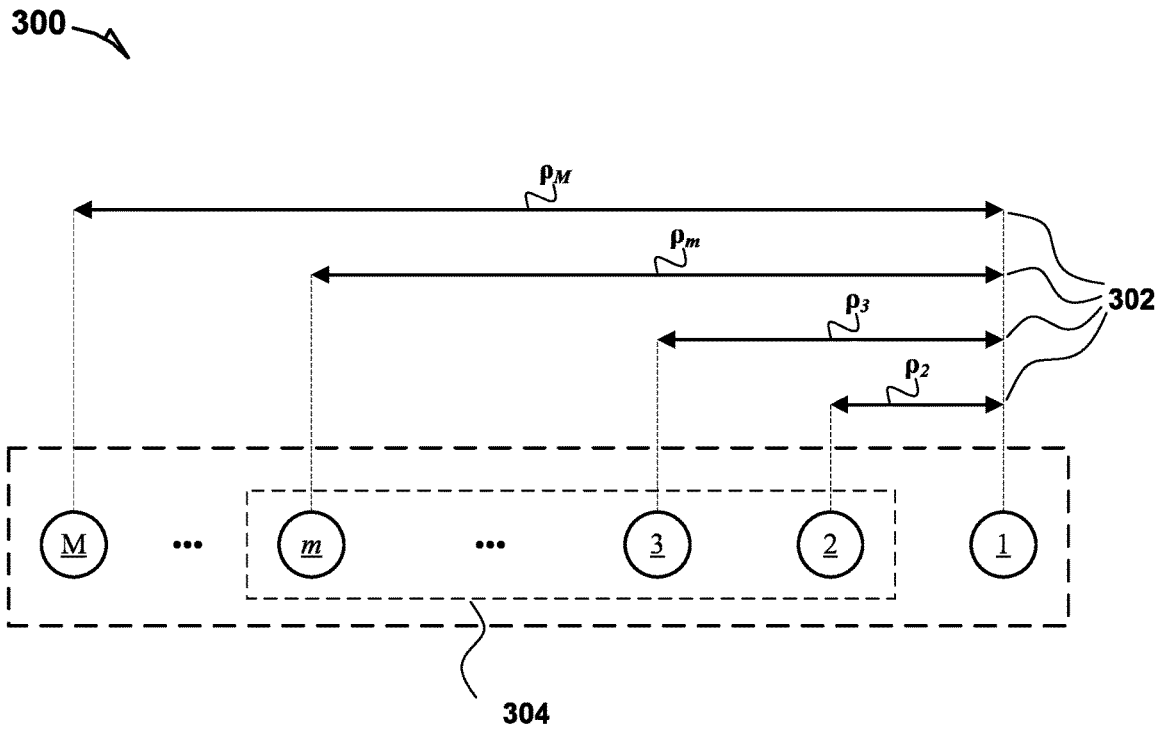
FIG. 3 shows an array geometry for a non-uniform LDMA and a subarray of microphones of the LDMA, according to an implementation of the present disclosure.
Figure 4:
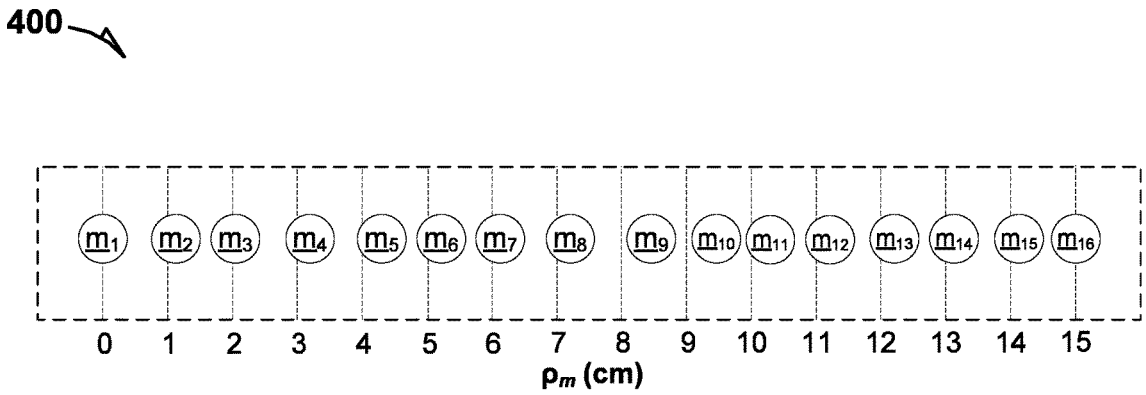
FIG. 4 shows an optimized array geometry for the microphones of a non-uniform LDMA, according to an implementation of the present disclosure.

Referring to FIG. 1, at 102, a processing device may start executing operations to construct an $N^{th}$ order LDMA with at most a number M of microphones flexibly distributed on a plane in a linear array geometry, e.g., LDMA 300 of FIG. 3.

For the ease of description without limitation, a reference point for the LDMA may coincide with a first microphone of the LDMA with the positions of the subsequent microphones (e.g., 2, 3 . . . ) being measured relative to the first microphone of the LDMA. Therefore, an array geometry for the LDMA may be described in terms of a distance $\rho_m$, with m=1, 2 . . . M, from the $m^{th}$ array element (e.g., $m^{th}$ microphone in LDMA 300) used for the LDMA to the reference point (e.g., the $1^{st}$ microphone). The direction of the source signal to the LDMA may be parameterized by the azimuthal angle θ. A steering vector represents the relative phase shifts for an incident far-field waveform across the microphones of a DMA. A steering vector for the LDMA, as described above, may be defined as:

$$d(\omega,\theta)=[1e^{-j\rho 2\omega \cos \theta/c} \ldots e^{-j\mu_M \omega \cos \theta/c}]^T.$$

where the superscript T is the transpose operator, j is the imaginary unit with $j^2=-1$, $\omega=2\pi f$ is the angular frequency, f>0 is the temporal frequency, and c is the speed of sound in air, which is generally assumed to be 340 m/s.

Linear DMAs generally have limited steering flexibility. Therefore, for the design of differential beamformers for linear microphone arrays, it may be assumed that the signal of interest comes from the endfire direction, i.e., θ=0°. Therefore, a linear microphone array observation signal vector may be written as:

$$y(\omega)=[Y_1(\omega)Y_2(\omega) \ldots Y_m(\omega)]^T=d(\omega)X(\omega)+v(\omega),$$

where $Y_m(\omega)$ is the received signal at the $m^{th}$ microphone, $d(\omega)=d(\omega, 0°)$ is the signal propagation vector, $X(\omega)$ is the source signal of interest, and $v(\omega)$ is the noise signal vector defined in a similar way to $y(\omega)$. The beamforming process may include applying a complex weight vector (e.g., a beamforming filter):

$$h(\omega)=[H_1(\omega)H_2(\omega) \ldots H_m(\omega))]^T,$$

where the superscript H represents the conjugate-transpose operator and $[H_1(\omega)\ H_1(\omega) \ldots H_M(\omega)]^T$ are spatial filters for the M microphones, to the noisy observation signal vector to obtain an output:

$$Z(\omega))=h^H(\omega)y(\omega)=h^H(\omega)d(W)X(W)+h^H(\omega)v(\omega)$$

where $Z(\omega)$ is the estimate of the signal of interest $X(\omega)$, and the superscript H is the conjugate-transpose operator.

A post-processor may convert the estimate $Z(\omega)$ (for each of a plurality of frequency bands) into the time domain to provide an estimate sound source represented as x(t). The estimated sound source x(t) may be determined with respect to the source signal received at each reference distance $\rho_m$, with m=1, 2 . . . M, for each array element (e.g., each microphone of LDMA 300 of FIG. 3) used for the LDMA.

At 104, the processing device may identify a number K of combinations of at least N+1 microphones of the M microphones.

To construct an $N^{th}$ order LDMA, we can either use all of the M microphone sensors or a subset (e.g., subarray) of the M microphone sensors. In other words, with a linear array of M microphones, an $N^{th}$ order LDMA may be constructed with a subarray of at least N+1 microphones of the M microphones. There are K different combinations of the M microphones that may be used to construct such N+1 sized subarrays of the LDMA, which may be expressed as:

$$K=\sum_{S=N+1}^{M}\binom{M}{S},$$

where $$\binom{M}{S}$$

represents the number of all the combinations of S array elements (e.g., microphones) taken from the M different array elements (e.g., microphones).

At 106, the processing device may specify a target cost function of at least one of: a beampattern, a directivity factor (DF), or a white noise gain (WNG) associated with the LDMA. Evaluating the cost function under specified conditions may help identify an optimal combination of subarrays with respect to beamforming performance.

The LDMA may be associated with a beampattern that reflects the sensitivity of a corresponding beamformer to a plane wave impinging on the LDMA from a particular angular direction θ. The beampattern for a plane wave impinging from an angle θ, on the LDMA described above, may be defined as:

$$B[h(\omega),\theta]=h^H(\omega)d(\omega,\theta).$$

A target frequency-invariant beampattern for an $N^{th}$ order DMA, corresponding to the incident angle θ of the sound signal, may be written as:

$$B_N(\theta)=\sum_{n=0}^{N}a_{N,n}\cos^n\theta,$$

where $a_{N,n}$ are the real coefficients that determines the shape of the different beampatterns of the Nth-order LDMA. The beampattern $B[h(\omega), \theta]$ after applying the beamforming filter $h(\omega)$ should match the target beampattern $B_N(\theta)$.

The DF represents the ability of a beamformer in suppressing spatial noise from directions other than the look direction (e.g., other than 0°). The DF associated with the LDMA, as described above, may be written as:

$$D[h(\omega)]=\frac{|h^H(\omega)d(\omega)|^2}{h^H(\omega)\Gamma_d(\omega)h(\omega)},$$

where $h(\omega)=[H_1(\omega)\ H_2(\omega) \ldots H_m(\omega)]^T$ is the global filter for a beamformer associated with the LDMA, the superscript H represents the conjugate-transpose operator, $[H_1(\omega)$ $H_1(\omega) \ldots H_M(\omega)]^T$ are spatial filters for the M microphones, and $\Gamma_d(\omega)$ is a pseudo-coherence matrix (with M×M elements) of the noise signal in a diffuse (spherically isotropic) noise field. The (i, j)th element of $\Gamma_d(\omega)$ may be denoted as:

$$[\Gamma_d(\omega)]_{ij} = \text{sinc}\left[\frac{\omega(\rho_i - \rho_j)}{c}\right],$$

where i, j=1, 2, . . . , M, sinc (x)=sinc (x/x), and c is the speed of sound.

The WNG evaluates the sensitivity of a beamformer to some of the LDMA's own imperfections (e.g., noise from its own hardware elements). The WNG associated with the LDMA, as described above, may be written as:

$$W[h(\omega)] = \frac{|h^H(\omega)d(\omega)|^2}{h^H(\omega)h(\omega)},$$

where $h(\omega))=[H_1(\omega)\ H_2(\omega)) \ldots H_m(\omega)]^T$ is a global filter for a beamformer associated with the LDMA, the superscript H represents the conjugate-transpose operator, and $[H_1(\omega)\ H_1(\omega)) \ldots H_M(\omega)]^T$ are spatial filters for the M microphones.

At 108, the processing device may, for each one of a number of frequency bands covering a frequency range, determine an optimal combination from the K combinations, wherein the optimal combination is determined based on an evaluation of the specified target cost function for the frequency band.

As noted above with respect to the array geometry of the LDMA, a distance $\rho_m$, with m=1, 2 . . . M, denotes the spacing between the $m^{th}$ microphone (used for the LDMA) and a specified reference point (e.g., the first microphone of the LDMA). Accordingly, a select subarray $\rho_{sub,k}$ of a vector $\rho=[\rho_1, \rho_2 \ldots \rho_m]^T$ may be used to denote an array geometry of the microphones used for the LDMA, wherein T is the transpose operator. Once such a geometry vector ρ is specified, for each subarray $\rho_{sub,k}$, the steering vector may be defined analogously to the steering vector described above with respect to 102 of method 100, and the beamforming filter $h(\omega, \rho_{sub,k})$ may be computed using the minimum-norm method described below with respect to 110 of method 100. Therefore, a cost function for the $k^{th}$ subarray at frequency ω may be defined as:

$$J[h(\omega,\rho_{sub,k})]=\mu_1\{\mathcal{D}[h(\omega,\rho_{sub,k})]-\mathcal{D}_0\}^2+\mu_2\mathcal{W}[h(\omega,\rho_{sub,k})]$$

where $\mathcal{D}_0$ is the target value for the DF, $\mathcal{D}[h(\omega, \rho_{sub,k})]$ and $\mathcal{W}[h(\omega, \rho_{sub,k})]$ are, respectively, the DF and WNG of the $k^{th}$ subarray with the beamforming filter $h(\omega, \rho_{sub,k})$, and $\mu_1$ and $\mu_2$ are two (real) weighting coefficients. The optimal subarray geometry (e.g., the values for $\rho_m$) at frequency ω is then determined as $$\rho_{sub,0,\omega} = \underset{\rho_{sub,k}}{\text{argmin}} J[h(\omega, \rho_{sub,k})].$$

At 110, the processing device may, for each frequency band of the plurality of frequency bands, perform beamforming using the determined optimal combination of microphones for the frequency band.

Performing the beamforming may include generating beamforming filters such as $h(\omega))=[H_1(\omega)\ H_2(\omega)) \ldots H_m(\omega)]^T$ described above with respect to 106 of method 100.

In the context of the LDMA described above, a distortionless constraint in the look direction (e.g., 0°) is desired, so that:

$$h^H(\omega))d(\omega)=1.$$

Therefore, for the above-noted LDMA, the problem of beamforming comprises designing a good beamforming filter $h(\omega)$ under the above-noted constraint in the look direction. To evaluate the designed beamforming filter, three performance measures may be used: the beampattern, DF, and WNG as described above with respect to step 106.

The beamforming filters $h(\omega)$ for the optimal combinations may be derived, for example, by using a minimum-norm method as follows. First, the target $N^{th}$ order LDMA beampattern may be assumed to have N distinct nulls, which satisfy $0° < \theta_{N,1} < \ldots < \theta_{N,N} \leq 180°$, so that the problem of DMA beamforming can be converted to one of solving the following linear equations:

$$D(\omega)h(\omega)=i_1,$$

where $$D(\omega) = \begin{bmatrix} d^H(\omega, 0^0) \\ d^H(\omega, \theta_{N,1}) \\ \vdots \\ \vdots \\ d^H(\omega, \theta_{N,N}) \end{bmatrix}$$

is an (N+1)×M matrix and $i_1=[1\ 0 \ldots 0]$ is a vector of length N=1. Then, to design an Nth order LDMA, at least N+1 microphones (of the at most M microphones) are used, e.g., M≥N+1. If M=N+1, the solution for $D(\omega)h(\omega)=i_1$ is $h(\omega)=D^{-1}(\omega)i_1$. However, this solution may suffer from white noise amplification at low frequencies. White noise amplification may be mitigated by increasing the number of microphones so that M>N=1. In this case, a minimum-norm solution for $D(\omega))h(\omega))=i_1$ is:

$$h_{MN}(\omega)D^H(\omega)b_{N\ \alpha},[D(\omega)D^H(\omega)]^{-1}i_1,$$

which may also be referred to as the maximum WNG (MWNG) differential beamformer because it maximizes the WNG for each of the optimal combination subarrays.

At 112, the processing device may end the execution of operations to construct an $N^{th}$ order LDMA. For example, the processing device may confirm that the beampattern $B[h(\omega), \theta]$, after applying the beamforming filter $h(\omega)$ derived from the minimum-norm solution for $D(\omega))h(\omega)=i_1$, substantially matches the target beampattern $B_N(\theta)$, as noted above with respect to 106 of method 100, for each of the geometrically optimal subarrays.

Figure 2:
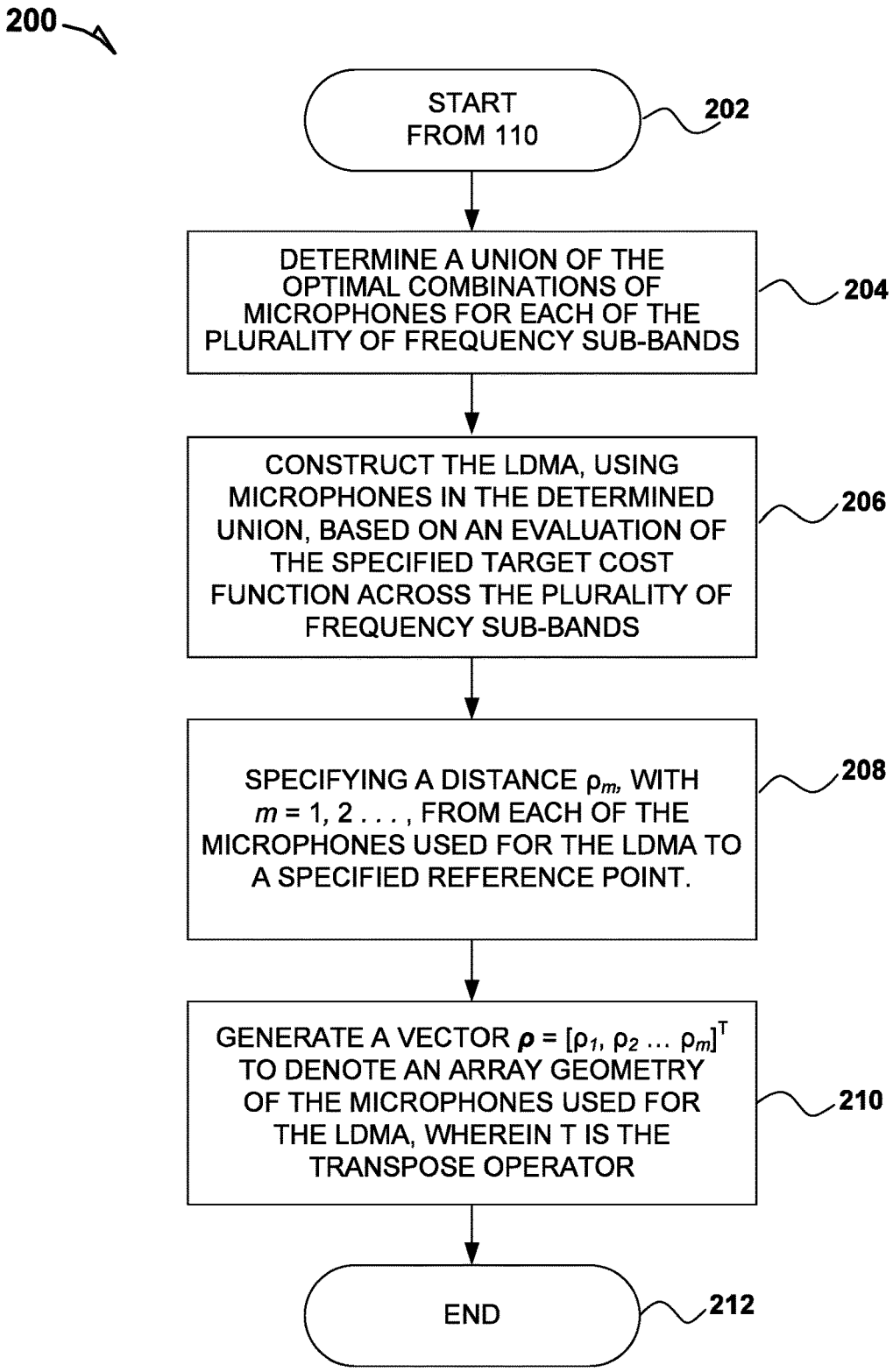
FIG. 2 is a flow diagram illustrating a method for constructing an LDMA based on geometric optimization across the plurality of frequency bands, according to an implementation of the present disclosure.

FIG. 2 is a flow diagram illustrating a method 200 for constructing an LDMA based on geometric optimization across the plurality of frequency bands, according to an implementation of the present disclosure.

Referring to FIG. 2, at 202, the processing device may start (e.g., continue from 110 of method 100 of FIG. 1) executing operations to construct an optimal $N^{th}$ order LDMA with at most M microphones flexibly distributed on a plane according to a linear array geometry, e.g., LDMA 300 of FIG. 3. As noted above, with respect to FIG. 1, the reference point for the LDMA may, without limitation, coincide with a first microphone of the constructed LDMA with the location of the other microphones (e.g., 2, 3, . . . M) being measured with respect to the location of the first microphone.

At 204, the processing device may determine a union of the optimal combinations of microphones, where each of the optimal combination is determined for a corresponding frequency band of the frequency bands covering the frequency spectrum.

Combining the optimal subarray geometries $\rho_{sub,0,\omega}$ (described above with respect to 108 of method 100 of FIG. 1) for each of the plurality of frequency bands across the entire frequency bands may generate a subarray set as follows:

$$C_{\rho_{sub}}=\{\rho_{sub,0,\omega}\}.$$

At 206, the processing device may construct the LDMA, using microphones in the determined union, based on an evaluation of the specified target cost function across the frequency bands over the frequency spectrum.

In this situation, the specified target cost function may be evaluated across the full range of frequency bands as:

$$J(C_{\rho_{sub}})=\sum_{\omega} J[h(\omega, \rho_{sub,0,\omega})]$$

where the optimal subarray set is then determined by:

$$C_{\rho_{sub}}=\underset{C_{\rho_{sub}}}{\operatorname{argmin}} J(C_{\rho_{sub}})$$

such that $\delta_\rho \geq \delta_{min}$ and $L_\rho \leq L_{max}$, where $\delta_\rho$ is the minimum inter-element spacing according to a linear array geometry denoted by a vector $\rho=[\rho_1, \rho_2 \ldots \rho_m]^T$ (as described above with respect to 108 of method 100 of FIG. 1), $\delta_{min}$ is the minimum tolerable inter-element (e.g., inter-microphone) spacing, $L_\rho$ is the array aperture according to $\rho$, and $L_{max}$ is the maximum tolerable array aperture. The array aperture $L_{max}$ represents the greatest distance between any two elements (e.g., microphones) of the array.

In an embodiment, determining the optimal subarray set may include using a particle swarm optimization (PSO) algorithm as described more fully with respect to Table 1 below.

At 208, the processing device may construct the LDMA using microphones in the union by specifying a distance $\rho_m$, with m=1, 2 . . . , from each of the microphones used for the LDMA to a specified reference point.

As noted above, the specified reference point may be the first microphone used in the LDMA so that the first distance $\rho_1=0$. Once the optimal subarray set has been determined, an optimum value for each $\rho_m$, of the LDMA as geometrically optimized across the plurality of frequency bands, may be specified based on the $\rho_m$ values for each corresponding microphone of the optimal subarray set. For example, the geometry of LDMA 300 of FIG. 3 includes distance values 302 for each of the microphones (e.g., $\rho_2, \rho_3, \ldots \rho_m, \ldots \rho_M$) of LDMA 300.

At 210, the processing device may generate a vector $\rho=[\rho_1, \rho_2 \ldots \rho_m]^T$ to denote an array geometry of the microphones used for the LDMA, wherein T is the transpose operator.

As noted above, with respect to 208, a linear array geometry for the constructed LDMA may be denoted by a vector $\rho=[\rho_1, \rho_2 \ldots \rho_m]^T$ (as described above with respect to 108 of method 100 of FIG. 1) where the values of $\rho_m$ are those specified for the LDMA at 208 above. Also as noted above, the optimum geometry for the LDMA (across the plurality of frequency bands) must also satisfy the following conditions: $\delta_\rho \geq \delta_{min}$ and $L_\rho \leq L_{max}$, where $\delta_\rho$ is the minimum inter-element spacing according to $\rho$, $\delta_{min}$ is the minimum tolerable inter-element (e.g., inter-microphone) spacing, $L_\rho$ is the array aperture according to $\rho$ and $L_{max}$ is the maximum tolerable array aperture. The array aperture represents the greatest distance between any two elements (e.g., microphones) of the array.

At 212, the processing device may end the execution of operations to construct an optimal $N^{th}$ order LDMA. For example, the processing device may confirm whether the beampattern $B[h(\omega), \theta]$, after applying the beamforming filter $h(\omega)$ derived from the minimum-norm solution for $D(\omega)h(\omega)=i_1$, substantially matches the target beampattern $B_N(\theta)$, as noted above with respect to 106 of method 100, for the geometrically optimal LDMA.

FIG. 3 shows an array geometry for a non-uniform LDMA 300 and a subarray 304 of microphones of the LDMA 300, according to an implementation of the present disclosure.

As noted above, LDMA 300 may include flexibly distributed microphones (1, 2, . . . m, . . . M) that are arranged according to a linear array geometry on a common plenary platform. The locations of these microphones may be specified with respect to a reference point (e.g., microphone 1). Also, as noted above, the coordinates of the microphones (1, 2, . . . m, . . . M) of LDMA 300 may be specified by a distance $\rho_m$, with m=1, 2 . . . M, which denotes the spacing between the $m^{th}$ microphone of the LDMA 300 and the specified reference point: microphone 1 of the LDMA 300. Accordingly, the vector $\rho=[\rho_1, \rho_2 \ldots \rho_m]^T$ may be used to denote an array geometry of the microphones (1, 2, . . . m, . . . M) of LDMA 300, wherein T is the transpose operator. It may be assumed that the maximum distance between two adjacent microphones max is smaller than the wavelength ($\lambda$) of an impinging sound wave.

As noted above, the specified reference point may be the first microphone used in the LDMA 300 so that the first distance $\rho_1=0$. Furthermore, the geometry of LDMA 300 of FIG. 3 may be specified by distance values 302 (e.g., $\rho_2$, $\rho_3, \ldots \rho_m, \ldots \rho_M$) for each of the microphones (1, 2, . . . m, . . . M) of LDMA 300.

In order to construct an $N^{th}$ order LDMA, we can either use all of the M microphone sensors of LDMA 300 or a subset (e.g., subarray 304) of the M microphone sensors. Therefore, since an $N^{th}$ order LDMA may be constructed with a subarray of at least N+1 microphones of the M microphones, there are K different combinations of the M microphones that may be used to construct such N+1 sized subarrays (e.g., subarray 304) of the LDMA 300, which may be expressed as:

$$K=\sum_{S=N+1}^{M}\binom{M}{S},$$

where $$\binom{M}{S}$$

represents the number of all the combinations of S array elements (e.g., microphones) taken from the M different array elements (e.g., microphones).

FIG. 4 shows an optimized array geometry for the microphones of a non-uniform LDMA 400, according to an implementation of the present disclosure.

LDMA 400 may include 16 flexibly distributed microphones ($m_1, m_2, \ldots m_{16}$) that are arranged according to a linear array geometry on a common plenary platform. The locations of these microphones may be specified with respect to a reference point (e.g., microphone $m_1$). As noted above, the coordinates of the microphones ($m_1, m_2, \ldots m_{16}$) of LDMA 400 may be specified by a distance $\rho_m$ (measured in cm along the bottom of LDMA 400), with m=1, 2 . . . 16, which denotes the spacing between the 1-16$^{th}$ microphones of the LDMA 400 and the specified reference point: microphone $m_1$ of the LDMA 400.

As noted above, a linear array geometry for LDMA 400 may be denoted by a vector $\rho=[\rho_1, \rho_2 \ldots \rho_m]^T$ where the values of $\rho_m$ must also satisfy the following conditions: $\delta_\rho \geq \delta_{min}$ and $L_\rho \leq L_{max}$, where $\delta_p$ is the minimum inter-element spacing according to $\rho$, $\delta_{min}$ is the minimum tolerable inter-element (e.g., inter-microphone) spacing, $L_p$ is the array aperture according to p and $L_{max}$ is the maximum tolerable array aperture. For LDMA 400, the minimum tolerable inter-element (e.g., inter-microphone) spacing may be set to $\delta_{min}$=0.4 cm (the value of $\delta_{min}$ may be chosen according to the size of the microphone sensors ($m_1, m_2, \ldots m_{16}$) of LDMA 400. The maximum tolerable array aperture (e.g., greatest distance between any two microphones) may be set to $L_{max}$=15 cm (e.g., the distance between $m_1$ and $m_{16}$, the first and last microphones of LDMA 400). The desired beampattern is chosen as the second order supercardioid, which has two nulls at 106° and 153°, respectively, and the corresponding DF is $\mathcal{D}_0$=8.0 dB.

To optimize the array geometry, the entire LDMA 400 may be divided into subarrays (e.g., subarray 402) for each of a plurality of 80 uniform frequency bands (e.g., 80 uniform frequency sub-bands of the 8-kHz full frequency band). The subarrays (e.g., subarray 402) may be based on the number of available microphones (e.g., 16 for LDMA 400) and the order N=2 of the desired geometrically optimized LDMA. The optimal subarray geometry (e.g., $\rho_m$ values for subarray 402) is then identified from all the K different combinations of the 16 microphones that may be used to construct such 2+1 sized subarrays (e.g., subarray 402) of the LDMA 400, which may be expressed as:

$$K = \sum_{S=3}^{16} \binom{16}{S} = \frac{16!}{(3!(16-3)!)} = 560,$$

where $$\binom{16}{S}$$

represents the number of all the combinations of S array elements (e.g., microphones) taken from the 16 array elements (e.g., $m_1, m_2, \ldots m_{16}$ of LDMA 400).

As noted with respect to 108 of method 100 of FIG. 1, after determining the possible subarray microphone combinations (e.g., subarray 402) using the combinatorial method described above, a cost function for the k$^{th}$ subarray at frequency $\omega$ (e.g., of the 80 frequency bands) may be defined as:

$$J[h(\omega,\rho_{sub,k})]=\mu_1\{\mathcal{D}[h(\omega,\rho_{sub,k})]-\mathcal{D}_0\}^2+\mu_2\mathcal{W}[h(\omega,\rho_{sub,k})].$$

as explained above with respect to 108 of method 100 of FIG. 1.

The set of optimal subarray geometries for each of the 80 frequency bands may then be optimized across the entire plurality of 80 frequency bands using the particle swarm optimization (PSO) algorithm, as summarized in Table 1 below. In the PSO algorithm, the acceleration factor and inertia weight may be set to $\gamma$=1.4961 and $\epsilon$=0.7298, respectively. In an embodiment, the variables in the cost function for the k$^{th}$ subarray at frequency $\omega$ may be calculated in the dB scale, and the weight coefficients in the cost function for the k$^{th}$ subarray at frequency $\omega$ may be set to $\mu_1$=1000 and $\mu_2$=−1, respectively. The array aperture of the subarrays, $L_{max}$, may be limited to less than $\zeta\lambda$, where $\lambda$ is the acoustic wavelength with an empirical value of $\zeta$=0.75.

For a comparison, the relative performances of a conventional DMA designed with the null-constraint method, a MWNG DMA, and a ZOU DMA are presented in FIG. 4 and FIG. 5 as described below. The conventional DMA is designed with a uniform linear array of M=3 and $\delta$=1 cm, the MWNG and ZOU beamformers are designed with a uniform linear array of M=16 and $\delta$=1 cm so that the array aperture is equal to the $L_{max}$ used for optimizing LDMA 400.

TABLE 1

DMA optimization algorithm based on PSO

```
Parameters:      acceleration factor, γ;
                 inertia weight, ε;
                 random number, κ ~ U (0, γ),
Initialization:  velocity, ξ ← ξ0;
                 geometry, p ← p0
                 compute Cpsub based on p;
                 ptemp = p
                 p0 = p;
Repeat:            Update the velocity ξ and the geometry p,
                   ξ ← ε · ξ + κγ · (ptemp − p) + κγ · (p0 − p).
                   If δp+ε ≥ δmin and Lp+ε ≤ Lmax,
                   p ← p + ξ
                   For each frequency ω
                     For each subarray psub,k
                       Compute the cost function J[h(ω,psub,k)].
                     End
                   End
                   Find psub,0,ω.
                   Form the subarray set Cpsub.
                   Compute the fullband cost J(Cpsub), J(Cptemp,sub).
                   If J(Cpsub) < J(Cptemp,sub),
                     ptemp = p,
                     Cptemp,sub = Cpsub.
                 End
                 Compute the fullband cost J(Cp0,sub).
                 If J(Cptemp,sub) < J(Cp0,sub),
                     p0 = ptemp,
                     Cpbest,sub = Cptemp,sub,
                     Cpsub,0 = Cp0,sub.
END
```

Figure 5:
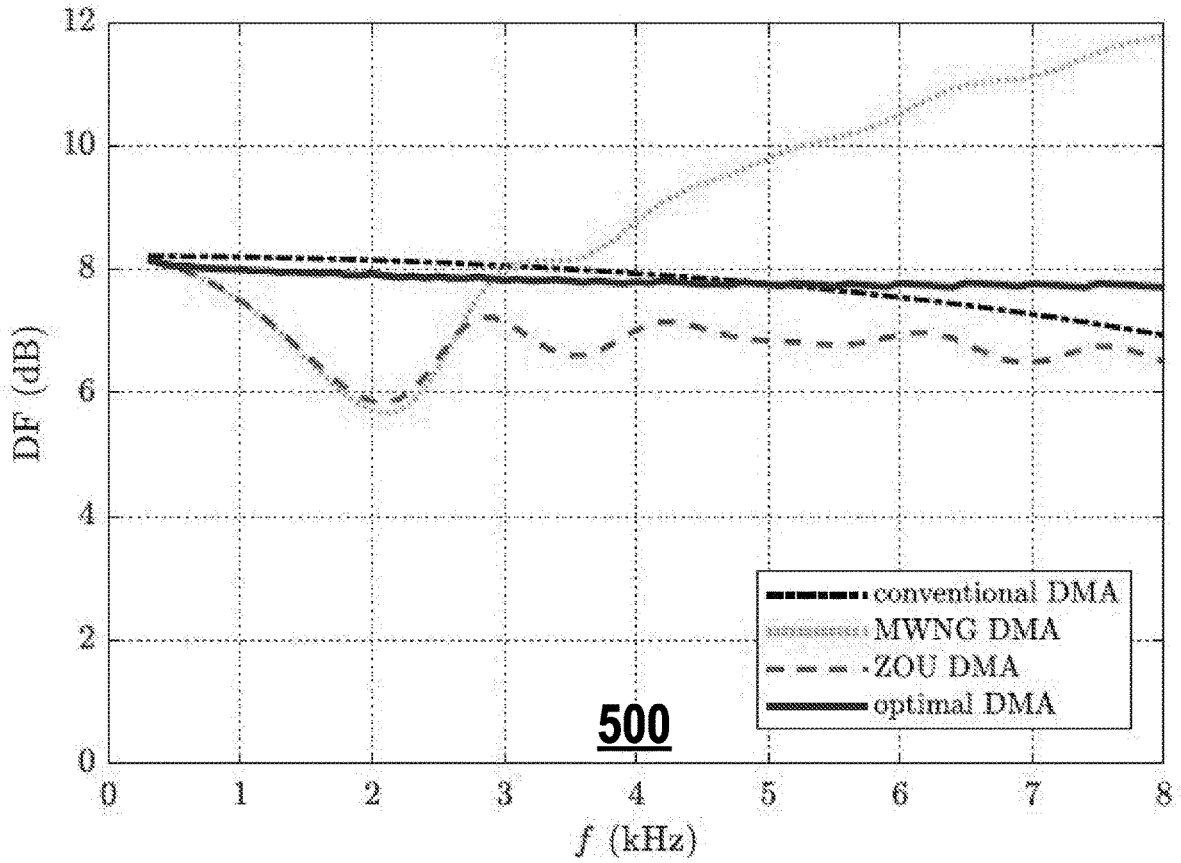
FIG. 5 shows a graph of directivity factor (DF) values for differential microphone arrays as a function of the frequency, according to an implementation of the disclosure.

FIG. 5 shows a graph 500 of DF values for differential microphone arrays as a function of the frequency, according to an implementation of the disclosure.

The graph 500 plots the corresponding DF values, as a function of frequency f (kHz), for the conventional, MWNG, ZOU, and geometrically optimal LDMA beamformers, respectively. As can be seen in the graph 500, the conventional DMA has achieved the desired value of DF (slightly varying with frequency), but it suffers from serious white noise amplification at low frequencies. The MWNG and ZOU DMA beamformers greatly improve the WNG (see graph 600 of FIG. 6), but the resulting DF values vary with frequency, indicating that the beampattern of the designed MWNG and ZOU DMA beamformers may be different from the target directivity pattern (e.g., $B_N(\theta)$, as noted above with respect to 106 of method 100).

In contrast, the proposed optimal DMA has almost frequency-invariant DFs and maintains the WNG at a reasonable level (see graph 600 of FIG. 6) in the 1-8 kHz frequency range. In an embodiment, it may be assumed that practical DMA systems can tolerate some amount of white noise amplification depending on the quality of microphone sensors. Therefore, the WNG may be controlled to be slightly smaller than 0 dB by adjusting the value of $\mu_2$.

Figure 6:
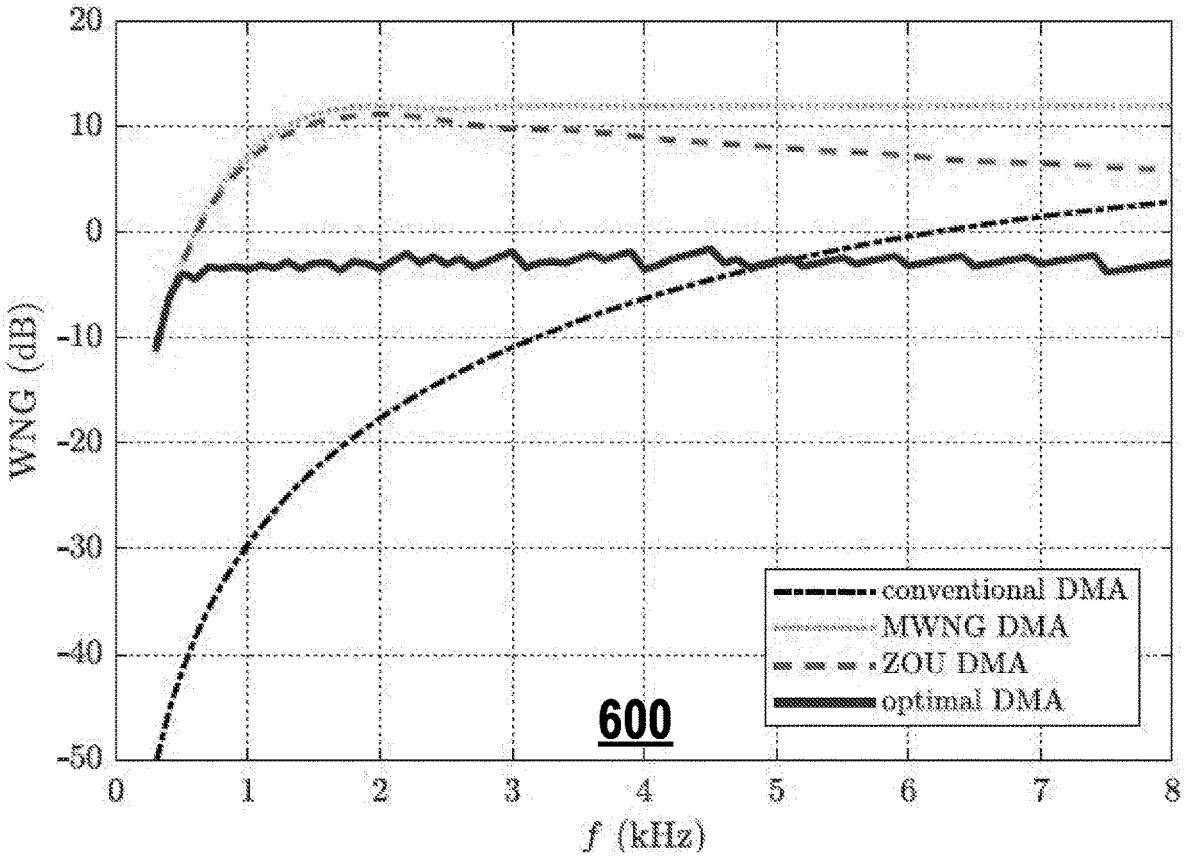
FIG. 6 shows a graph of white noise gain (WNG) values for differential microphone arrays as a function of the frequency, according to an implementation of the disclosure.

FIG. 6 shows a graph 600 of WNG values for differential microphone arrays as a function of the frequency, according to an implementation of the disclosure.

The graph 600 plots the corresponding WNG values, as a function of frequency f (kHz), for the conventional, MWNG, ZOU, and geometrically optimal LDMA beamformers, respectively. As can be seen in the graph 600, MWNG and ZOU DMA beamformers greatly improve the WNG, but the resulting DF values (see graph 500 of FIG. 5) vary with frequency, indicating that the beampattern of the designed MWNG and ZOU DMA beamformers may be different from the target directivity pattern (e.g., $B_N(\theta)$, as noted above with respect to 106 of method 100). The conventional DMA achieved the desired value of DF (slightly varying with frequency as shown in graph 500 of FIG. 5), but suffers from white noise amplification at low frequencies.

In contrast, the proposed optimal DMA has almost frequency-invariant DFs (see graph 500 of FIG. 5) and maintains the WNG at a reasonable level in the 1-8 kHz frequency range. In an embodiment, it may be assumed that practical DMA systems can tolerate some amount of white noise amplification depending on the quality of microphone sensors. Therefore, the WNG may be controlled to be slightly smaller than 0 dB by adjusting the value of $\mu_2$.

Three-Dimensional Beampatterns:

A comparison of 3-dimensional beampatterns of the four noted DMA beamformer methods, e.g., the conventional, MWNG, ZOU, and geometrically optimal LDMA beamformers, respectively also illustrates the performance of the respective methods. Although not shown in the FIGs., the 3-dimensional beampattern of the DMA with the conventional method is similar as the target directivity pattern and is almost frequency invariant. The 3-dimensional beampattern of the MWNG beamformer varies with frequency and it is different from the target beampattern at high frequencies. The ZOU beamformer has successfully mitigated the extra-null problem (so did the MWNG beamformer), but its beampattern still varies slightly with frequency. In comparison, the geometrically optimal DMA achieves a frequency-invariant beampattern throughout the entire frequency band of interest (e.g., the 8 zHz frequency range).

Figure 7:
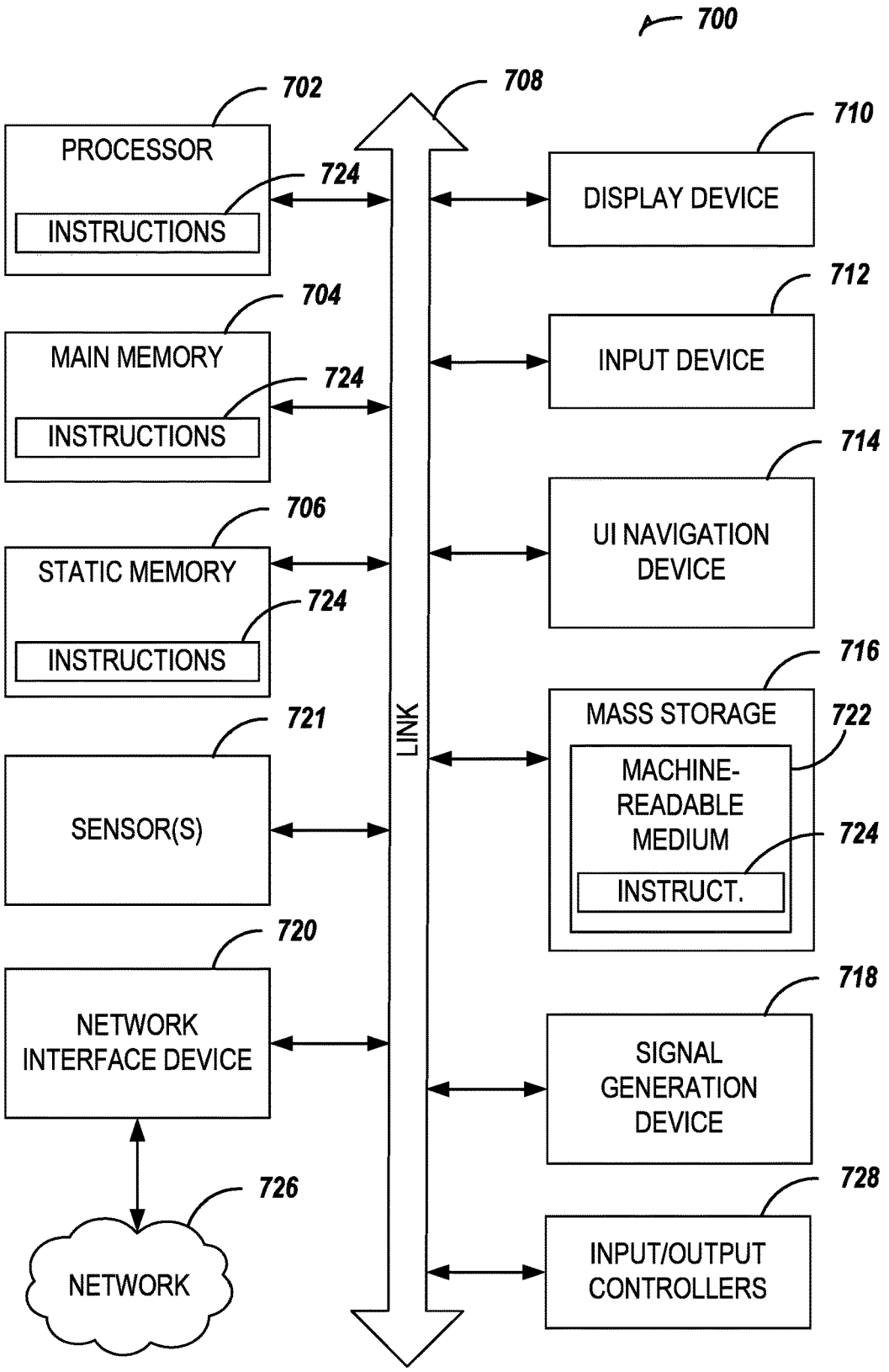
FIG. 7 is a block diagram illustrating a machine in the example form of a computer system, within which a set or sequence of instructions may be executed to cause the machine to perform any one of the methodologies discussed herein.

FIG. 7 is a block diagram illustrating a machine in the example form of a computer system 700, within which a set or sequence of instructions may be executed to cause the machine to perform any one of the methodologies discussed herein.

In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be an onboard vehicle system, wearable device, personal computer (PC), a tablet PC, a hybrid tablet, a personal digital assistant (PDA), a mobile telephone, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 700 includes at least one processor 702 (e.g., a central processing unit (CPU), a graphics processing unit (GPU) or both, processor cores, compute nodes, etc.), a main memory 704 and a static memory 706, which communicate with each other via a link 708 (e.g., bus). The computer system 700 may further include a video display unit 710, an alphanumeric input device 712 (e.g., a keyboard), and a user interface (UI) navigation device 714 (e.g., a mouse). In one embodiment, the display device 710, input device 712 and UI navigation device 714 are incorporated into a touch screen display. The computer system 700 may additionally include a storage device 716 (e.g., a drive unit), a signal generation device 718 (e.g., a speaker), a network interface device 720, and one or more sensors 721, such as a global positioning system (GPS) sensor, compass, accelerometer, gyrometer, magnetometer, or other sensors.

The storage device 716 includes a machine-readable medium 722 on which is stored one or more sets of data structures and instructions 724 (e.g., software) embodying or utilized by any one or more of the methodologies or functions described herein. The instructions 724 may also reside, completely or at least partially, within the main memory 704, static memory 706, and/or within the processor 702 during execution thereof by the computer system 700, with the main memory 704, static memory 706, and the processor 702 also constituting machine-readable media.

While the machine-readable medium 722 is illustrated in an example embodiment to be a single medium, the term "machine-readable medium" may include a single medium or multiple media (e.g., a centralized or distributed database, and/or associated caches and servers) that store the one or more instructions 724. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. Specific examples of machine-readable media include volatile or non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 724 may further be transmitted or received over a communications network 726 using a transmission medium via the network interface device 720 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Wi-Fi, 3G, and 4G LTE/LTE-A or WiMAX networks). Input/output controllers 728 may receive input and output requests from the central processor 702, and then send device-specific control signals to the devices they control (e.g., display device 710). The input/output controllers 728 may also manage the data flow to and from the computer system 700. This may free the central processor 702 from involvement with the details of controlling each input/output device.

Language: In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

Some portions of the detailed description have been presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "segmenting", "analyzing", "determining", "enabling", "identifying," "modifying" or the like, refer to the actions and processes of a computer system, or similar electronic computing device, that manipulates and transforms data represented as physical (e.g., electronic) quantities within the computer system's registers and memories into other data represented as physical quantities within the computer system memories or other such information storage, transmission or display devices.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

Reference throughout this specification to "one implementation" or "an implementation" means that a particular feature, structure, or characteristic described in connection with the implementation is included in at least one implementation. Thus, the appearances of the phrase "in one implementation" or "in an implementation" in various places throughout this specification are not necessarily all referring to the same implementation. In addition, the term "or" is intended to mean an inclusive "or" rather than an exclusive "or."

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. A method for constructing a linear differential microphone array (LDMA) of order N including at most a number M of microphones, where M is greater than N, the method comprising:

identifying, by a processing device, a number K of combinations of at least N+1 microphones of the M microphones;

specifying, by the processing device, a target cost function comprising at least one of a beampattern, a directivity factor (DF), or a white noise gain (WNG) associated with the LDMA; and for each frequency band of a plurality of frequency bands:

determining, by the processing device, an optimal combination from the K combinations, wherein the optimal combination is determined based on an evaluation of the specified target cost function for the frequency band; and performing, by the processing device, beamforming using the determined optimal combination of microphones for the frequency band.

2. The method of claim 1, wherein determining the optimal combination from the K combinations comprises using a particle swarm optimization (PSO) algorithm.

3. The method of claim 1, further comprising:

determining a union of optimal combinations of microphones, wherein each one of the optimal combinations is determined for a corresponding one of the plurality of frequency bands; and constructing the LDMA, using microphones in the determined union, based on an evaluation of the specified target cost function across the plurality of frequency bands.

4. The method of claim 3, wherein the constructed LDMA comprises at least N+1 microphones, of the M microphones, distributed non-uniformly on a linear platform, and wherein a minimum interelement spacing of the LDMA is greater than a first specified value and a maximum aperture of the LDMA is smaller than a second specified value.

5. The method of claim 3, wherein constructing the LDMA using microphones in the union comprises specifying a distance $\rho_m$, with m=1, 2 . . . , M from each of the microphones used for the LDMA to a specified reference point.

6. The method of claim 5, wherein the specified reference point comprises a first microphone of the microphones used for the LDMA so that $\rho_1=0$.

7. The method of claim 5, further comprising generating a vector $\rho=[\rho_1, \rho_2 \ldots \rho_m]^T$ to denote an array geometry of the microphones used for the LDMA, wherein T is the transpose operator.

8. An $N^{th}$ order linear differential microphone array (LDMA) system comprising:

at most a number M of microphones on a linear platform; and a processing device, communicatively coupled to the microphones, to:

identify a number K of combinations of at least N+1 microphones of the M microphones;

specify a target cost function comprising at least one of a beampattern, a directivity factor (DF), or a white noise gain (WNG) associated with the LDMA; and for each frequency band of a plurality of frequency bands:

determine an optimal combination from the K combinations, wherein the optimal combination is determined based on an evaluation of the specified target cost function for the frequency band; and perform beamforming using the determined optimal combination of microphones for the frequency band.

9. The LDMA system of claim 8, wherein determining the optimal combination from the K combinations comprises using a particle swarm optimization (PSO) algorithm.

10. The LDMA system of claim 8, the processing device further to:

determine a union of the optimal combinations of microphones, wherein each one of the optimal combinations is determined for a corresponding one of the plurality of frequency bands; and construct the LDMA, using microphones in the determined union, based on an evaluation of the specified target cost function across the plurality of frequency bands.

11. The LDMA system of claim 10, wherein the constructed LDMA comprises at least N+1 microphones, of the M microphones, distributed non-uniformly on the linear platform, and wherein a minimum interelement spacing of the LDMA is greater than a first specified value and a maximum aperture of the LDMA is smaller than a second specified value.

12. The LDMA system of claim 10, wherein constructing the LDMA using microphones in the union comprises specifying a distance $\rho_m$, with m=1, 2 . . . M, from each of the microphones used for the LDMA to a specified reference point.

13. The LDMA system of claim 12, wherein the specified reference point comprises a first microphone of the microphones used for the LDMA so that $\rho_1=0$.

14. The LDMA system of claim 12, the processing device further to: generate a vector $\rho=[\rho_1, \rho_2 \ldots \rho_m]^T$ to denote an array geometry of the microphones used for the LDMA, wherein T is the transpose operator.

15. A non-transitory machine-readable storage medium storing executable instructions which, when executed, cause a processing device to:

identify, by a processing device, a number K of combinations of at least (N+1) microphones of a number M microphones for constructing an Nth order linear differential microphone array (LDMA);

specify a target cost function comprising at least one of a beampattern, a directivity factor (DF), or a white noise gain (WNG) associated with the LDMA; and for each frequency band of a plurality of frequency bands:

determine an optimal combination from the K combinations, wherein the optimal combination is determined based on an evaluation of the specified target cost function for the frequency band; and perform beamforming using the determined optimal combination of microphones for the frequency band.

16. The machine-readable storage medium of claim 15, wherein determining the optimal combination from the K combinations comprises using a particle swarm optimization (PSO) algorithm.

17. The machine-readable storage medium of claim 15, further comprising instructions which, when executed, cause the processing device to:

determine a union of the optimal combinations of microphones, wherein each one of the optimal combinations is determined for a corresponding one of the plurality of frequency bands; and construct the LDMA, using microphones in the determined union, based on an evaluation of the specified target cost function across the plurality of frequency bands.

18. The machine-readable storage medium of claim 17, wherein the constructed LDMA comprises at least N+1 microphones, of the M microphones, distributed non-uniformly on the linear platform, and wherein a minimum interelement spacing of the LDMA is greater than a first specified value and a maximum aperture of the LDMA is smaller than a second specified value.

19. The machine-readable storage medium of claim 17, wherein constructing the LDMA using microphones in the union comprises specifying a distance $\rho_m$, with m=1, 2 . . . M, from each of the microphones used for the LDMA to a specified reference point.

20. The machine-readable storage medium of claim 19, further comprising instructions which, when executed, cause the processing device to: generate a vector $\rho=[\rho_1, \rho_2 \ldots \rho_m]^T$ to denote an array geometry of the microphones used for the LDMA, wherein T is the transpose operator.

* * * * *